US006369720B1

(12) United States Patent
Wilhelm

(10) Patent No.: US 6,369,720 B1
(45) Date of Patent: Apr. 9, 2002

(54) METHOD FOR INFORMATION TRANSMISSION OF VEHICLE DATA AND TRAFFIC INFORMATION SYSTEM

(75) Inventor: Michael Wilhelm, Vaihingen (DE)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/315,948

(22) Filed: May 21, 1999

(30) Foreign Application Priority Data

May 22, 1998 (DE) ..... 198 22 914

(51) Int. Cl.[7] ..... G08G 1/09

(52) U.S. Cl. ..... 340/905; 340/435; 340/903; 342/457; 455/11.1

(58) Field of Search ..... 340/901, 902, 340/903, 905, 435, 988, 426; 180/167, 168; 342/457, 357; 455/11.1, 7; 701/117

(56) References Cited

U.S. PATENT DOCUMENTS

| | | | | |
|---|---|---|---|---|
| 3,790,780 A | * | 2/1974 | Helmcke et al. | 340/903 |
| 5,051,735 A | * | 9/1991 | Furukawa | 340/905 |
| 5,424,726 A | * | 6/1995 | Beymer | 340/905 |
| 5,428,544 A | * | 6/1995 | Shyu | 340/902 |
| 5,680,122 A | * | 10/1997 | Mio | 340/902 |
| 5,684,474 A | * | 11/1997 | Gilon et al. | 340/903 |
| 5,757,268 A | * | 5/1998 | Toffolo et al. | 340/461 |
| 5,781,119 A | * | 7/1998 | Yamashita et al. | 340/905 |
| 5,847,661 A | * | 12/1998 | Ricci | 340/902 |
| 6,236,337 B1 | * | 5/2001 | Beier et al. | 340/905 |

FOREIGN PATENT DOCUMENTS

| | | |
|---|---|---|
| DE | 31 38 377 A1 | 4/1983 |
| DE | 39 15 466 A1 | 12/1989 |
| DE | 39 41 402 A1 | 6/1991 |
| DE | 40 04 816 A1 | 9/1991 |
| DE | 41 12 594 A1 | 12/1991 |
| DE | 40 34 681 A1 | 5/1992 |
| DE | 42 02 489 A1 | 7/1993 |
| DE | 42 18 804 A1 | 12/1993 |
| DE | 43 19 904 A1 | 12/1994 |
| DE | 43 21 416 A1 | 1/1995 |
| DE | 44 25 530 A1 | 2/1995 |
| DE | 44 38 666 A1 | 5/1995 |
| DE | 44 46 512 A1 | 6/1996 |
| DE | 196 04 084 A1 | 10/1996 |
| DE | 296 07 255 U1 | 1/1997 |
| DE | 297 00 652 U1 | 7/1997 |
| DE | 196 24 116 C1 | 8/1997 |
| DE | 197 44 602 A1 | 4/1998 |
| EP | 0 682 281 A1 | 11/1995 |
| EP | 0 715 286 A1 | 6/1996 |
| EP | 0 817 151 A1 | 1/1998 |
| EP | 0 817 152 A1 | 1/1998 |
| WO | WO 88/05176 | 7/1988 |
| WO | WO 95/03664 | 2/1995 |
| WO | WO 97/01940 | 1/1997 |

OTHER PUBLICATIONS

"Notfunksystem Arthur verhindert Massenkarambolagen" ELO Aug. 1998, p. 18.

"TELE AID—ein Rettungssystem als Symbiose aus Kfz–Elekronik, Mobilfunknetz und Satellitenkommunikation" Telekom praxis, 10/97, pp. 43–45.

"Viel zu spat oder falsch", Focus 20/1997.

* cited by examiner

*Primary Examiner*—Brent A. Swarthout
(74) *Attorney, Agent, or Firm*—Sughrue Mion, PLLC

(57) ABSTRACT

A method for information transmission and visualization of vehicle data detected by sensors, particularly speed, lighting status, tripping of ABS, steering wheel turning angle, position, etc., between the vehicles, as well as a corresponding traffic information system. To implement a "predictive" driving aid to prevent congestion and accidents, the method uses a cellular network for information transmission and overlays the transmitted data onto the windshield of the vehicle.

16 Claims, 2 Drawing Sheets

METHOD FOR INFORMATION TRANSMISSION OF VEHICLE DATA AND TRAFFIC INFORMATION SYSTEM

The invention relates to a method for information transmission and visualization of vehicle data detected by sensors and a traffic information system.

BACKGROUND OF THE INVENTION

The invention relates to a method for information transmission and visualization of vehicle data detected by sensors and a traffic information system according to the preambles of claims 1 and 6.

To control traffic flow requires a significant amount of current data, which is frequently not available. When traffic congestion is reported, data is processed only to provide information on how to make a detour around the congestion (traffic information broadcasting) and not to prevent congestion in advance. Traffic flow control by means of traffic lane loops, which control traffic signaling equipment using a control unit, is known in the art. The disadvantage of these systems is that they are permanently installed and thus pick up traffic data for traffic flow control only at certain points, which are spaced far apart. Traffic control or prevention of oscillating traffic flows, which typically lead to congestion, is not possible with these systems. Traffic information broadcasting via car radios has also proven unsuccessful for achieving better traffic flow (see FOCUS magazine, 22/1997, pp. 207/208).

Also known in the art is the radio transmission of information by other road users regarding signal switching (DE 42 02 489 A1, DE 196 24 116 C1), accident reports (DE 40 04816 A1), and distance to the vehicle traveling ahead (DE 39 15 466 A1 and DE 31 38 377 A1). The disadvantage of these methods is that only special data is transmitted, which is not sufficient to combat the main cause of traffic interruptions, namely non-adapted driving behavior. Furthermore, particularly with infrared transmission, there is the problem that subsequent vehicles may travel in the "shadow" of vehicles, e.g. trucks, which are not equipped with such an information transmission system, so that the information chain to the following vehicles is interrupted. In addition, particularly in city traffic, false alarms due to a flashing turn signal may easily occur if this signal is interpreted as a warning signal so that the warning flash system is automatically switched on in correspondingly equipped vehicles.

SUMMARY OF THE INVENTION

Thus it is an object of the invention to define a method and a traffic information system, which permits a significantly greater traffic density and prevents congestion and accidents.

According to the invention, preventative traffic flow control is achieved, in particular, because the steering component, namely the person sitting behind the wheel, as well as the vehicle electronics are integrated in the control process. This is achieved in that each vehicle or driver is continuously provided with advance information to permit a corresponding reaction. The overlaying of the transmitted data on the windshield of the vehicle permits safe driving even in dense fog or at night. The GSM technology cellular system moreover solves the problem of interruption of the information chain due to "shadow information" behind vehicles, particularly trucks or buses, which are not equipped with this system. The method is furthermore independent of the weather. Irrespective of visibility, information regarding the acceleration or braking process of a vehicle traveling ahead is always available. This makes it possible for the driver of the following vehicle to react in a more appropriate fashion. Oscillating vehicle flows and congestion and risk of accidents are limited.

An advantageous further development increases the security of the information exchange. Information loss due to collapse as a result of information overflow is prevented by automatic or manual preselection of suitable priority classes. At very high average speeds, only information of the highest priority should be frequently transmitted. Furthermore, transmitter power may also be adapted to the speed or average speed to ensure that if traffic is light, an accident at a relatively great distance (e.g., 1 kilometer) is detected. On the other hand, at high traffic density, smaller cells should be used to receive information in quick succession from information transmitters located at close range.

The features of present invention permit simple implementation of an orientation aid. A path progress overlaid, for example, on the lower left corner of the windshield is very helpful for visualizing additional data, which may be superimposed over the path progress in the form of symbols. Such path actions may include, but are not limited to, activation of windshield wipers, fog headlights, and brakes, as well as average speed and congestion warnings. If the brakes are applied to a vehicle traveling ahead and the wheels react differently, the cause may be icy or wet roads, which permits conclusions about the road conditions. The path progress is simply determined by sensors detecting the steering motions or the angular position of the front wheels, e.g., of the 20 or 100, etc., vehicles traveling ahead.

According to the present invention, only the data of the vehicles traveling ahead is received. Since the driver is thus informed, for example, that the ten vehicles ahead are traveling at an average speed of 110 km/hr and, furthermore, that these vehicles are accelerating or braking, he can adapt his own driving behavior in good time. This prevents traffic congestion and accidents.

In accordance with the present invention, the vehicles can furthermore be used as relay stations in order to relay information to vehicles traveling in the opposite direction. This provides a communication network for transmitting not only traffic data but also any type of message. Transmission security may be assessed as high since the information is broadcast through different channels. Any unintended transmission of information or influence on the opposing traffic may be prevented, for example, by using a compass to determine the approximate travel direction and using the data derived therefrom for selecting irrelevant information. It is also feasible in advance to provide variable, directed emission by means of array antennas corresponding to the course of the curves. Transmitter power can also be adjusted accordingly.

Another aspect of the present invention provides a traffic information system, which permits the visualization of information of all types, e.g., average speed, points where accidents frequently occur, next gas station, hotels, etc., as well as current traffic, road conditions, and weather data by overlay onto the windshield of the vehicle.

Another aspect of the present invention provides fixed stations that are preferably integrated in the cellular network. These fixed stations can serve, in particular, for the compilation of statistical data as a function of the time of day, the day of the week, etc., to determine traffic density, (average) speed, accident probability, and other data, and to transmit this information to the road users where indicated.

Furthermore, the statistical data thus determined may be used to control the marking of points where accidents frequently occur, speed limit signs, and other signaling equipment. Fixed stations may also be used to provide translation of the information into other languages, to signal the next gas station, the next hotel, and the like to the road users, as well as to relay information to the police, and may even server as "electronic mail boxes" with messages or information, for example, for goods traffic or for vehicles driving in column formation.

Another aspect of the present invention provides the system components for implementing a traffic information system of the aforementioned type. In addition to the windshield overlay means for driver information, an interface for direct control of the vehicle electrical system may be provided. For example, the lighting or the windshield wiper system may be automatically switched on in response to received signals.

BRIEF DESCRIPTION OF THE DRAWING

Below, the invention is further explained by means of an exemplary embodiment depicted in the figures, wherein.

DETAILED DESCRIPTION OF THE INVENTION

Figure 1:
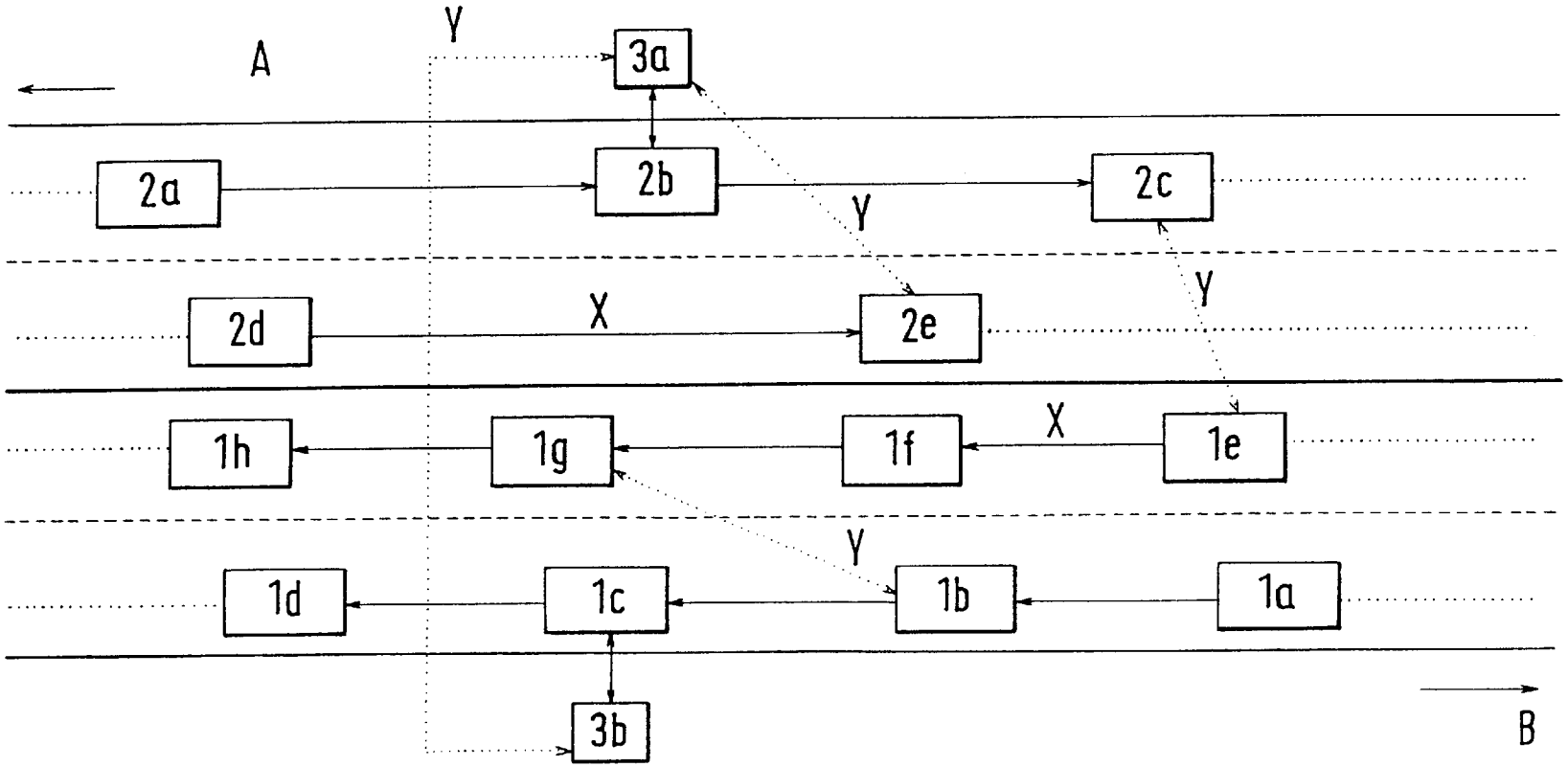
FIG. 1 shows a schematic diagram to illustrate the method.

FIG. 1 shows an interstate scenario where vehicles 1*a* through 1*h* are traveling in travel direction B and vehicles 2*a* through 2*e* are traveling in opposite direction A. Vehicles traveling behind each other, respectively, are connected by radio links X of a cellular GSM network. The arrows symbolize the information transmission direction, i.e., from the vehicle traveling in front to the vehicle following it. The use of a cellular network has the advantage that not all vehicles have to be equipped with a corresponding send and receive device since there is no risk of information link interruption due to shadowing. Additional radio links Y may be provided between vehicles traveling in different directions (in the exemplary embodiment between 1*e* and 2*c*), between vehicles traveling in different lanes in the same direction (in the exemplary embodiment between 1*b* and 1*g*), between vehicles and fixed stations 3*a*, 3*b* (in the exemplary embodiment between Vehicle 2*e* and fixed station 3*a*, and between vehicle 1*c* and fixed station 3*b*), as well as between a plurality of fixed stations 3*a* and 3*b*. The fixed stations 3*a* and 3*b* may be used to relay traffic information to the police, to collect statistics on that path segment, to determine the vehicle density and average speeds, to control signaling equipment along that path, e.g., with respect to points where accidents frequently occur, speed limits, etc., and possibly relay information regarding the next gas station, the next hotel, etc. to the passing vehicle 1*a* through 1*h* and 2*a* through 2*e*. This information may also be translated into different languages and fixed stations 3*a* and 3*b* may implement "electronic mail boxes" with information for goods traffic, etc. Vehicles 1*a* through 1*h* and 2*a* through 2*e*, in turn, transmit vehicle data of all types detected by sensors, e.g., current speed or actions such as acceleration, braking, windshield wipers, or fog headlights to or from, as well as steering wheel motions or angle data of the front axle. The latter type of information is used as input signals for overlaying a forecast path, for example, in the lower corner of the windshield of the vehicles traveling behind. For this purpose, vehicles 1*a* through 1*h* and 2*a* through 2*e* are equipped with a computer 4 (FIG. 2) to process all this information. Particularly for path determination, the specific data available may also be converted into a continuous path diagram by interpolation. The vehicle data listed above by way of example and the vehicle actions are overlaid onto this path in an ergonomically advantageous fashion. This weather-independent process simplifies driving behavior that is adapted to traffic, weather, and road conditions as well as to actual events such as accidents, roadblocks, or construction areas.

Figure 2:
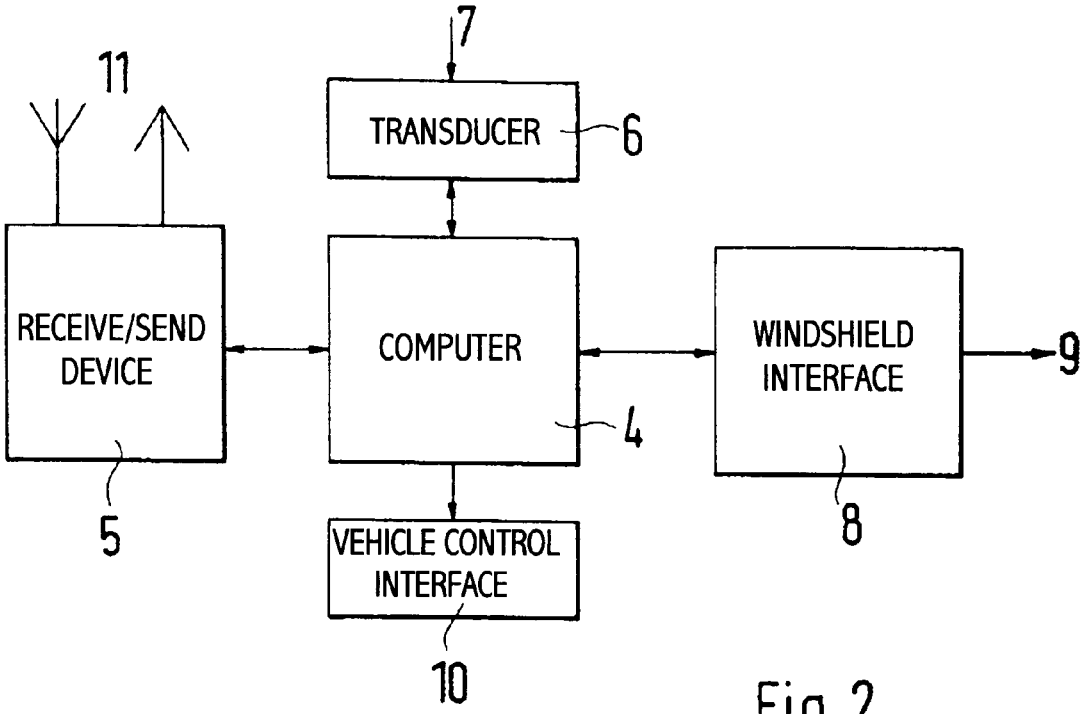
FIG. 2 depicts the system components for information processing in the vehicles.

FIG. 2 shows an exemplary embodiment of the essential system components disposed on the vehicle (1*a* through 1*h*, 2*a* through 2*e*) for implementing a traffic information system according to the invention. The principle item is a computer 4 connected with a receive and send device 5, and a transducer 6 with connected vehicle sensors 7 for bilateral information transmission. Also connected to computer 4 is an interface 8 serving to control the windshield overlay means 9. Where indicated, an additional interface 10 for vehicle control may be connected to computer 4. The receive and send device 5 is connected with receive and send antennas 11, which may have predetermined direction characteristics. These antennas 11 may be formed, for example, as array antennas. Computer 4 preferably serves also for speed-dependent selection of information to be relayed to interface 8 for windshield overlay 9. For this purpose, the data may be classified in advance by stored priority classes.

The invention is not limited to the aforementioned exemplary embodiment. Rather, a number of variants are conceivable, which use the features of the invention, even though their basic design differs.

What is claimed is:

1. A method for information transmission and visualization of data from a vehicle having a plurality of sensors, the method comprising:

collecting data from the plurality of vehicle sensors;

transmitting the data collected from the plurality of vehicle sensors through a cellular network to other vehicles travelling in a substantially parallel direction or travelling in a substantially opposing direction, wherein transmitting the collected data further comprises:

assigning a priority to the collected data; and transmitting the collected data as a function of vehicle speed;

receiving vehicle data transmitted through the cellular network from other vehicles;

processing the transmitted vehicle data and overlaying the processed vehicle data on a display.

2. The method according to claim 1, the method further comprises:

determining a path progress based upon a front wheel position of at least one vehicle traveling in front of the vehicle receiving the information; and overlaying a position or distance onto the windshield of the vehicle receiving the information.

3. The method according to claim 1, wherein the method further comprises transmitting the collected data to vehicles traveling behind the vehicle collecting the data.

4. The method according to claim 1, wherein the method further comprises transmitting the collected data to vehicles traveling in a direction substantially opposite to the vehicle collecting the data.

5. The method according to claim 1, wherein collecting data from the plurality of sensors comprises collecting vehicle parameters and external environmental conditions.

6. A traffic information apparatus for information transmission and visualization of data from a vehicle, the apparatus comprising:

a cellular transmitter and receiver connected to an antenna;

a plurality of vehicle sensors that collect data comprising vehicle parameters;

a driver information device; and a computer connected to the cellular transmitter and receiver, the plurality of vehicle sensors and the driver information device, wherein the computer assigns priorities to the data collected from the plurality of vehicle sensors, and wherein the cellular transmitter and receiver transmits data collected from the plurality of vehicle sensors according to the priorities assigned to the data.

7. The traffic information apparatus according to claim 6, wherein the cellular transmitter and receiver communicates with at least one fixed station of a GSM cellular network.

8. The traffic information apparatus according to claim 6, the apparatus further comprising an interface connected to a steering control device in a vehicle, wherein the interface is connected to the computer.

9. The traffic information apparatus according to claim 6, wherein the cellular transmitter and receiver transmits data collected from the plurality of vehicle sensors to other vehicles traveling behind.

10. The traffic information apparatus according to claim 6, wherein the cellular transmitter and receiver receives data from other vehicles.

11. The traffic information apparatus according to claim 10, wherein the computer overlays the received data from other vehicles on the display.

12. The traffic information apparatus according to claim 8 wherein the interface controls the steering control device in response to received data.

13. An apparatus for information transmission and visualization of data from a vehicle, the apparatus comprising:

a plurality of vehicle sensors for collecting vehicle data;

a cellular transmitter and receiver connected to an antenna for sending and receiving collected vehicle data to at least one fixed cellular station;

a computer for processing vehicle data received from the cellular transmitter and receiver, and for sending the collected vehicle data to the cellular transmitter and receiver for transmission, wherein the computer assigns priorities to the data collected from the plurality of vehicle sensors, and wherein the cellular transmitter and receiver transmits data collected from the plurality of vehicle sensors according to the priorities assigned to the data; and a display for displaying the processed vehicle data or the collected vehicle data.

14. The apparatus for information transmission and visualization of data from a vehicle as claimed in claim 13, wherein the apparatus further comprises an control interface to the vehicle steering system for steering the vehicle in response to received processed vehicle data.

15. The apparatus for information transmission and visualization of data from a vehicle as claimed in claim 13, wherein the at least one fixed cellular station is connected to a GSM network.

16. A method for information transmission and visualization of data from a vehicle having a plurality of sensors, the method comprising:

collecting data from the plurality of vehicle sensors;

transmitting the data collected from the plurality of vehicle sensors through a cellular network to other vehicles travelling in a substantially parallel direction or travelling in a substantially opposing direction;

receiving vehicle data transmitted through the cellular network from other vehicles;

processing the transmitted vehicle data;

determining a path progress based upon a front wheel position of at least one vehicle traveling in front of the vehicle receiving the information; and overlaying the processed vehicle data on a display, and overlaying a position or distance onto the windshield of the vehicle receiving the information.

* * * * *